United States Patent [19]

Mayr

[11] Patent Number: 5,020,760

[45] Date of Patent: Jun. 4, 1991

[54] HOT WATER TANK BRACKET ASSEMBLY

[76] Inventor: Robert S. Mayr, 7301 Langley Canyon Rd., Salinas, Calif. 93907

[21] Appl. No.: 507,991

[22] Filed: Apr. 12, 1990

[51] Int. Cl.[5] ..... A47K 1/08

[52] U.S. Cl. ..... 248/313; 248/231; 410/49

[58] Field of Search ..... 248/313, 231, 230, 309.1, 248/154; 206/6; 220/445; 410/49, 50

[56] References Cited

U.S. PATENT DOCUMENTS

| | | | |
|---|---|---|---|
| 2,684,825 | 7/1954 | Laviana et al. | 410/49 |
| 2,901,201 | 8/1959 | Taylor et al. | 410/50 |
| 2,936,992 | 5/1960 | Browning | 248/313 |
| 3,105,594 | 10/1963 | Ewers | 248/313 X |
| 3,463,429 | 8/1969 | Novak | 248/154 X |
| 3,510,142 | 5/1970 | Erke | 410/50 X |
| 3,730,144 | 5/1973 | Arzberger . | |
| 3,805,988 | 4/1974 | Walker et al. . | |
| 4,768,741 | 9/1988 | Logsdon . | |
| 4,844,396 | 7/1989 | Norton . | |

FOREIGN PATENT DOCUMENTS

| | | | |
|---|---|---|---|
| 0603490 | 8/1960 | Canada | 248/313 |

*Primary Examiner*—Ramon O. Ramirez

*Attorney, Agent, or Firm*—Flehr, Hohbach, Test, Albritton & Herbert

[57] ABSTRACT

A hot water tank bracket assembly for affixing the tank to the framing studs of buildings, thereby, providing a secure stable mount of the tank to the wall in the vent of a moderate or substantial sized earthquake. Preferably, the bracket assembly comprises a mounting bracket, a high-strength flexible strap to secure the water tank to the bracket, and mounting flanges which can be slid along the edge of the bracket to permit aligning of the mounting flanges to the framing studs. Additionally, the edge facing the bracket is arcuate in shape in order to receive and cradle a significant portion of the water tank periphery.

15 Claims, 3 Drawing Sheets

HOT WATER TANK BRACKET ASSEMBLY

TECHNICAL FIELD

The present invention relates, in general, to gas-heated, hot water tanks typically employed in homes, commercial buildings, or the like, and more particularly, relates to an apparatus used for securing and mounting hot water tanks to the walls and framing studs of such buildings.

BACKGROUND OF THE INVENTION

In areas which experience earthquakes, a very high percentage of the number of fires which are caused by the quake are the result of gas-heated, hot water tanks which tip over during the earthquake. It has been estimated that as high as 90% of the house fires which occur are a direct result of water heater instability.

Typically, water heaters are either not stabilized at all (other than by their plumbing), or they are mounted by plumber's strapping or L-shaped brackets to sheetrock, or occasionally framing studs, by a nail or screw. Moreover, the hot water tank is often placed on a pedestal or raised section of the flooring where such placement further increases the water heater's instability and susceptibility to tipping. Little in the way of code requirement for the securement of hot water tanks has been enacted. While plumber's strapping of L-shaped brackets have been adequate mounting devices during stable, nonearth movement conditions, various problems have occurred when such devices were exposed to the severe acceleration caused by a earthquake. Earthquakes often generate P-waves (rolling type compression waves) which travel along the surface of the earth's crust. These waves tend to sway objects from side-to-side and are generally the main cause of most building damage due to the earthquake itself. Likewise, the momentum of the water tank gained due to seismic accelerations, coupled with the fact that a filled 50 gallon hot water tank can weigh in excess of 500 pounds, has led to disastrous results. Under earthquake conditions, strapping frequently will go slack or experience a stress reversal which allows the water tank transverse or lateral momentum to build, and the increasing momentum pulls the nail or screw from the wallboard or breaks the strapping or brackets. Since brackets are often secured to the thin metal of the tank housing by screws, such fasteners also can pull out of the tank wall. Thus, as the acceleration becomes significant, prior water tank securement assemblies have typically failed under earthquake conditions. As already mentioned, this instability of gas-heated water tanks has resulted in fires and major gas leaks.

Few, if any, attempts to lessen or overcome the problem of gas-heated, hot water tank instability have been made. The prior art has not addressed the peculiar environment inherent in an earthquake condition, nor has the prior art addressed the problem of the extreme mass of a hot water tank. What attempts have occurred have largely been based upon providing a separate enclosure for the water storing tank. Thus, Arzberger, U.S. Pat. No. 3,730,144, for example, discloses a hot beverage dispenser enclosed in a housing. The storage tank is secured via a bracket and a strapping means which is subsequently connected by a vertical stabilizing rod embedded in the base of the water tank. More importantly, Arzberger does not fasten the water tank to the housing nor does the bracket employed provide a versatile alignment means capable of securement to the varying locations at which framing studs may occur in a wall. Thus, the simplistic bracket and strapping means utilized in Arzberger is not adequate for the specific requirements of the present invention.

There are other means for mounting tanks within enclosures in which straps and buckles are employed to secure the tank. One such securement means is disclosed in U.S. Pat. No. 3,805,988 to Walker et al. However, the assembly set forth is not suitable for mounting the type of heated water tanks used in homes and industries. The mounting means utilized in Walker is only sufficient for smaller portable tanks which are periodically removed and replaced. Walker does not have the versatility of aligning the means for attachment to the enclosure with the framing studs as required by the present invention. Furthermore, the strapping and buckle means supplied in Walker are more adequate for ease of removal. Thus, it follows that because of the inappropriate design and the excessive weight of a hot water tank, it would eventually pull free of the sheetrock under earthquake conditions.

Finally, there are other securing methods which relate generally to strapping assemblies for hanging pipes. Typical of these systems are the pipe mountings disclosed in Loosdon and Norton, U.S. Pat. Nos. 4,768,741 and 4,844,396, respectively. Both the strapping assemblies, however, are not suitable for use with large water storage tanks under earthquake type conditions.

While the prior disclosures have been satisfactory for many applications, it has been found to be highly desirable to provide an assembly capable of securing a hot water tank of substantial mass to a stable structure, such as the framing studs of a building.

Accordingly, it is an object of the present invention to provide a hot water tank bracket assembly which can withstand the substantial seismic accelerations common to moderated or large earthquakes.

It is another object of the present invention to provide a hot water tank bracket assembly which provides a bracket suitable for placement juxtaposed a wall which simultaneously cradles the water tank for maximum stability, yet facilitates the removal and replacement of the water tank.

It is yet another object of the present invention to provide a hot water tank bracket assembly which can be retrofit in existing installations for positive fastening of the tank to framing studs of a building.

It is a further object of the present invention to provide a hot water tank bracket assembly which is durable, compact, easy to maintain, has a minimum number of components and is economical to manufacture.

The apparatus of the present invention has other objects and features of advantage which will become apparent from and are set forth in more detail in the description of the Best Mode of Carrying Out the Invention and the accompanying drawing.

SUMMARY OF THE INVENTION

In summary, the hot water tank bracket assembly of the present invention is particularly suitable for use in any buildings such as homes, commercial buildings, industrial institutions or the like which are situated in unstable ground movement areas. During periods of ground instability, the bracketing designed in accordance with the present invention provides a slack-free cradle for the water tank and positively fastens it to the relatively stable framing studs. Unlike current mounting methods and techniques, only a virtual collapse of the adjoining framing studs will cause the water tank to topple. As will be described briefly here and in more detail hereinafter, the hot water tank bracket assembly of the present invention comprises a water tank mounting bracket, a flexible strapping material and movable mounting flanges for alignment and securement to the framing studs. Most preferably, the tank bracket, which contains an arcuate edge, substantially conforms to and mates with a significant portion of the water tank periphery. Additionally, the high-strength flexible strapping material is then tightly fastened to the bracket, thereby securing the bracket and strap assembly to the tank housing against movement relative to the housing. The mounting flanges are slidably mounted to the tank bracket. Once the location of a couple framing studs are established, the flanges are subsequently aligned and secured against movement to the bracket. Fasteners, such as lag screws, then are used to fasten the flanges, and thus the bracket assembly and tank, to the studs against transverse or lateral movement relative to the studs. Mounting these flanges to the framing studs result in a superior stabilization of the water tank unattainable from the current apparatus and techniques.

The hot water tank bracket assembly of the present invention and the method in which it is installed will be described in more detail below in conjunction with the drawings.

BRIEF DESCRIPTION OF THE DRAWINGS

Additional objects and features of the invention will be more readily apparent from the following detailed description and appended claims when taken in conjunction with the drawings, in which:

BEST MODE FOR CARRYING OUT THE INVENTION

Reference will now be made in detail to the preferred embodiments of the invention, examples of which are illustrated in the accompanying drawings. While the present invention has been described with reference to a few specific embodiments, the description is illustrative of the invention and is not to be construed as limiting the invention. Similarly, although primarily designed to stabilize water tanks from ground instability of the type usually experienced by both moderate and major earthquakes, the present invention may also be employed where any movements may be experienced such as by ocean vessels, severe vibratory areas due to machinery, explosions, or the like. Various modifications may occur to those skilled in the art without departing from the true spirit and scope of the invention as defined by the appended claims.

Figure 1:
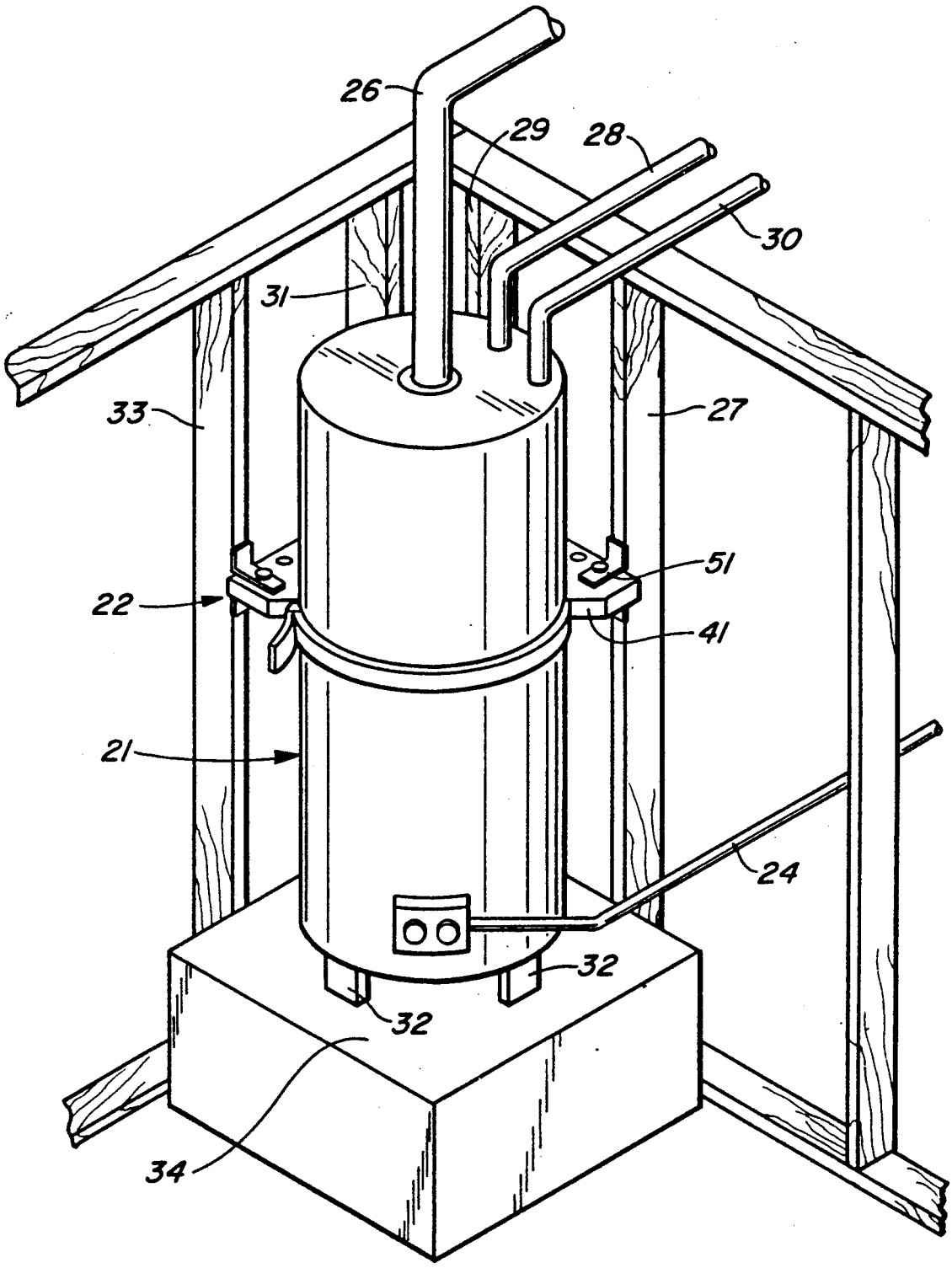
FIG. 1 is a top perspective view of a hot water tank installation secured against tipping over by a bracket assembly constructed in accordance with the present invention.
Figure 2:
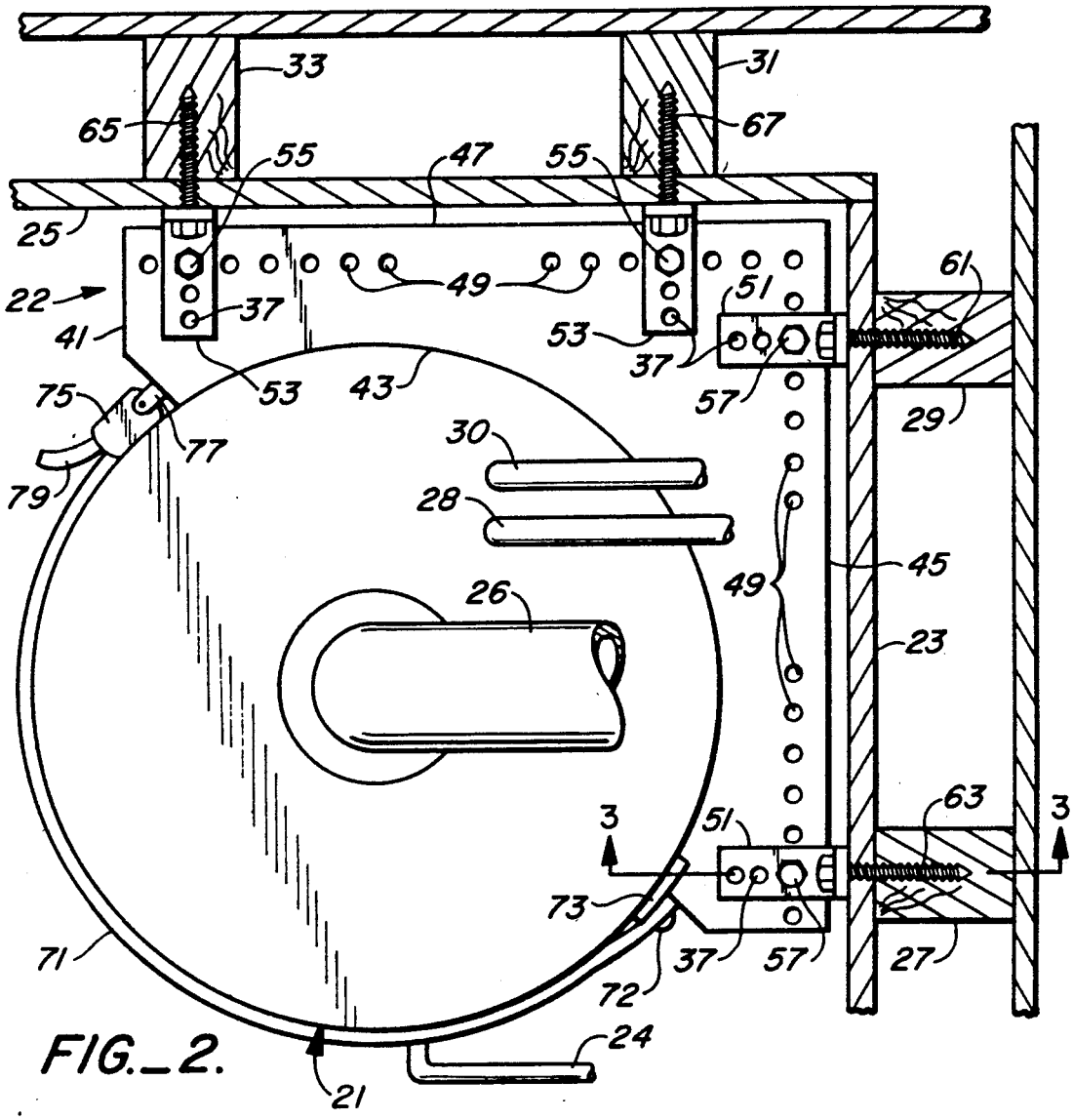
FIG. 2 is an enlarged, top plane view of the hot water tank and bracket assembly of FIG. 1.

Turning now to the drawings, wherein like components are designated by like reference numerals throughout the various figures. In FIGS. 1 and 2 a water tank, generally designated 21, is mounted to a corner wall structure using the bracket assembly, generally designated 22, of the present invention. As illustrated, hot water tank 21 is typically mounted proximate a corner of a small room or space in the home. Customarily, plasterboard sheets 23 and 25 are mounted to 2"×4" frame members 27, 29, 31 and 33. Tank 21 preferably is mounted in a somewhat spaced condition from the sheetrock panels 23 and 25 in order to enable plumbing of the same and to minimize heat transfer to the sheetrock.

More particularly, in a typical installation tank 21 will include a gas inlet conduit 24 which is coupled to a gas burner (not shown) and an exhaust gas conduit 26 which communicates combustion gases to the exterior of the building. Also coupled to the tank 21 are a water inlet conduit or pipe 28 and hot water outlet pipe 30. Typically, hot water heater 21 also includes a set of legs 32 which elevate the tank from the floor 34, and often tank 21 will be positioned on a raised platform 34.

While conduits 24, 26, 28 and 30 have some stabilizing effect on hot water heater 21, they are not designed for that purpose, and experience shows that they are not effective in preventing the hot water tank assembly from tipping over. Similarly, there are gas valve shut-off mechanisms which are sometimes installed on or proximate water heaters, but the mass of tank assembly 21 can break inlet conduit 24 upstream of the shut off valve, and a spark can ignite the escaping gas. Clearly, securement of the tank assembly against tipping adds very substantially to the overall safety of a hot water tank assembly in areas where moderate or major earthquakes are likely to occur.

In order to secure tank 21 against tipping over, a bracket 41 is provided which has an arcuate surface 43 formed to substantially mate with and receive a significant portion of the periphery of tank 21. Arcuate surface 43 cradles tank 21, providing security and stability; yet, the cradling capability is not so cumbersome as to impair removal or replacement of tank 21. Additionally, bracket 41 is formed with sides or edges 45 and 47, which are juxtaposed to sheetrock panels 23 and 25.

Mounted to bracket 41 is a strap-like member 71, which is secured to and extends from mounting ear 73 to buckle or coupling assembly 75. The combination of bracket 41 and strap-like member or belt 71, therefore, provides a first means or bracket means extending substantially around, in this embodiment completely around, tank 21. As will be described further, moreover, the cradle surface 43 and flexible belt 71 secure the first means to tank 21 against any lateral or transverse movement with respect to the tank.

One major reason that the use of plumber's strapping is ineffective to stabilize hot water heaters is that the motion of the tank can be in any direction transverse to the tank's longitudinal axis. (Vertical motion, of course, often accompanies the transverse motion.) This unpredictable motion will produce oscillation that can be effectively resisted in one direction (if the strapping is strong enough) but after results in a slack condition in the strapping in the opposite direction. The result of the strapping going slack is that significant displacement of the tank can occur in one direction which will be reinforced by the earthquake motion. The slack in the strapping, therefore, can allow momentum to build in the tank, with the result that the strapping or strapping fasteners will fail.

In the present invention, therefore, one important feature of bracket assembly 22 is that it provides a slack-free positive coupling of the tank to a building structure which is not likely to fail during an earthquake, such as framing studs 27, 29, 31 and 33. In the present bracket assembly, the first or bracket means comprised of bracket 41 and belt 71 is secured in slack-free relation to the tank, preferably by cinching the belt down against the tank to seat the tank against cradle surface 43.

In order to positively secure bracket 41 in substantially slack-free relation to the wall structure, second means or mounting means, preferably in the form of slidable mounting flanges 51 and 53, are mounted to bracket 41. Any known method of adjustably mounting flanges 51 and 53 to bracket 41 may be utilized as long as a substantially slack-free connection results. However, in the preferred form, a plurality of bolt receiving bracket holes 49 are spaced apart and extend along each of bracket edges 45 and 47.

Figure 3:
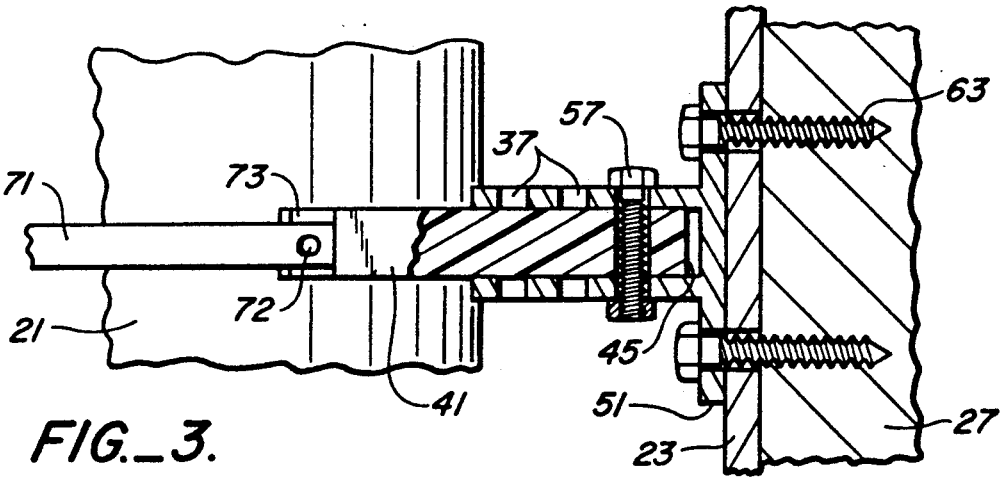
FIG. 3 is a fragmentary, cross-sectional side elevation view of a bracket mounting flange taken substantially along the plane of line 2—2 in FIG. 1.

FIG. 3, further, illustrates an enlarged, fragmentary, side elevation view of bracket mounting flange 51. As designed in accordance with the present invention, flanges 51 and 53 are U-shaped with at least one flange hole 37 formed therein which will receive a bolt, such as bolts 55 and 57, therethrough so as to secure or lock the mounting flanges 51 and 53 to the edges 45 and 47 of bracket 41. Thus, referring to FIG. 2, mounting flanges 51 on edge 45 can be slid along bracket edge 45 until they are aligned with framing studs 27 and 29. At that point, lag screws 61 and 63 can be screwed in through the wallboard and into the 2"×4"'s. Depending on the size of framing studs 27 and 29, lag screws 61 and 63 may be of the same size, type and quality. Likewise, the mounting flanges 53 may be slid along edge 47 until they are aligned with studs 31 and 33. Mounting screws 65 and 67 then can be screwed into studs 31 and 33, which are set typically, but not always, at about 16 inch centers. The adjustability of the mounting flanges is an important feature of the present invention since it facilitates retrofitting, and in many instances the studs in corner structures are irregularly spaced. Greater detail of the mounting flange assembly may be observed in FIG. 3.

Furthermore, as is apparent in FIG. 2, and as illustrated in FIG. 3, flanges 51 and 53, themselves, preferably include a plurality of bolt receiving flange holes 37 which are spaced apart in a direction outwardly from the studs and extend through the U-shaped portion of flanges 51 and 53. Thus, flanges 51 and 53 are not only slidable along edges 45 and 47, but edges 45 and 47 are also adjustable outwardly with respect to the distance from the framing studs and sheetrock panels 23 and 25. This feature facilitates retrofitting of bracket assembly 22 to existing hot water tank installations, and may well be required because of wall irregularities and the need to run plumbing between the bracket and wall. As will be apparent, bracket 41 also could be formed with a plurality of rows of openings 49, which are spaced apart in outwardly spaced relation, to permit various spacings from the building walls. As set forth above, bolts 55 and 57 secure mounting flanges 51 and 53 to edges 45 and 47, and lag screws 61, 63, 65 and 67 positively secure the adjustable mounting flanges to the framing studs. Holes 37 even may contain a lower threaded portion of the U-shaped section of flanges 51 and 53, as shown in FIG. 2. Bracket 41, therefore, can be customized further to the space or form provided.

The hot water tank 21 can be secured against transverse displacement relative to mounting bracket 41 by several techniques. One would be comprised of use of a high-strength, wide fabric belt 71 of the type used, for example, in seat belt construction. Such material is amply flexible, yet, still provides the necessary strength and stability to secure a heavy cumbersome water tank under the stressful earthquake conditions. As shown in FIGS. 2 and 3, belt 71 can be secured bY a fastener 72 to a mounting ear or flange 73 at one end of the bracket and secured by a coupling buckle or housing 75 which releasably grips U-shaped buckle mount 77 secured to bracket 41 proximate end 79 of the belt. The housing 75 preferably includes a structure which will allow the belt end 79 to be cinched down so the belt 71 is secured tightly against the water tank. Such coupling devices are common in the field and provide easy coupling and de-coupling. Thus, arcuate surface 43, belt 71 and buckle 75 cooperate to extend tightly around the periphery of tank 21, thereby providing a stable, slack-free attachment of bracket 41 to tank 21.

Another embodiment could include a metal strapping which is secured at both ends to bracket 41 with essentially no slack between the strapping and the tank. It is important that belt 71 hold the tank against the mating bracket surface 43 so that relative acceleration between the bracket, tank and belt will not occur. It is further noted that the adjustable tightness of the bracket-strap assembly to tank 21 is wholly independent of the positioning of flanges 51 and 53 along the bracket so as to be aligned with framing studs 27, 29, 31 or 33, or another building structure. This is unlike the conventional plumber's strapping systems in which the tightness of the strapping is dependent upon the attachment of the strapping ends to the adjacent wall.

Figure 4:
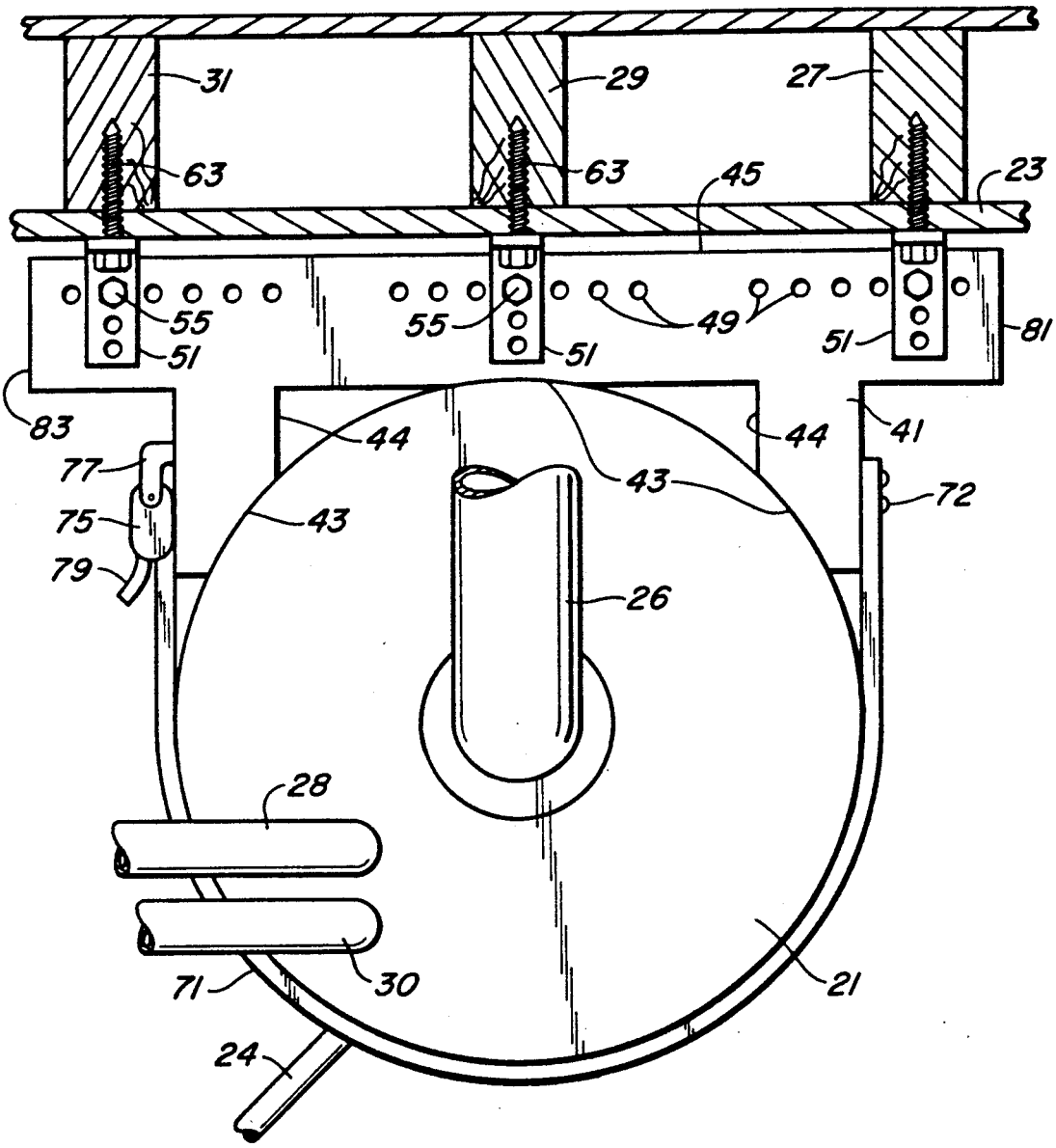
FIG. 4 is a top plane view showing an alternative embodiment of the bracket assembly of the present invention.

FIG. 4 illustrates further alternative embodiments of the same bracket assembly. Here, the hot water tank bracket assembly can principally be used to secure a hot water tank against a straight wall as opposed to a corner. Preferably that version of the mounting bracket will have a longer edge 45 which is juxtaposed to straight wall 23 and two, or even three, slidable mounting flanges that can be aligned with framing studs. As shown in FIG. 4, bracket 41 contains extended portions 81 and 83 which ultimately further extends wall facing edge 45. Flanges 51 are slidably aligned with framing studs 27, 29 and 31 and subsequently mounted to bracket 41 in a similar fashion as described above. This embodiment of bracket 41 also includes an arcuate surface 43, which substantially mates with a portion of the periphery of hot water tank 21, and strapping means 71 draws the tank up against mating surface 43. As will be seen, surface 43 need not continuously engage tank 21, and can include recessed areas 44.

In most installations, securement of the hot water tank by a bracket as above described positioned between about the middle of the tank and about one foot from the top of the tank will prevent the tank from tipping over. However, when the tank is placed on a pedestal, additional safety can be achieved by using a second bracket positioned approximately one foot from the bottom of the tank as well.

Brackets 41 are shown in the drawing as being formed of a solid plastic material, but it will be understood that they also may be formed of a metal or even wood. If metal is used a sheet metal which is rolled formed to provide sufficient rigidity is desirable. Mounting flanges 51 and 53 are shown as being U-shaped and extending over the top and bottom of bracket 41. It will be appreciated that L-shaped mounting flanges could be employed and that bracket 41 could be formed with U-shaped edges which receive a leg of the mounting flanges. Similarly, while fasteners 61, 63, 65 and 67 are shown as lag screws, other means for positively securing the bracket-strap assembly to the building wall structure can be provided. Finally, it is also possible to have strap 71 extend completely around the tank and be slidably received by bracket 41.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

The hot water heater stabilizing bracket assembly of the present invention, therefore, provides a slackfree system for positively coupling a hot water tank to a building structural element which usually only fails under the most extreme of earthquake conditions. The present invention can be retrofit to a wide variety of installations to significantly reduce the fire hazard, which can cause as much damage as the damage produced by motion.

What is claimed is:

1. An apparatus for securing a hot water tank, having an outer housing, against lateral movement relative to a wall of a building, said apparatus comprising:

a bracket means extending circumferentially around the entire outer periphery of said housing, said bracket means being secured to said housing against transverse displacement relative to said housing; and mounting means for substantially slack-free mounting of said bracket means to said wall, said mounting means being disengagably connectable to said bracket means at a selected position of a plurality of positions to permit alignment of said mounting means with a plurality of positions on said wall independently of relative displacement of said bracket means with respect to said outer periphery of said housing, said mounting means further including fastening means for positively fastening said mounting means to said wall against transverse displacement relative to said wall, whereby said hot water tank is securely affixed to said wall.

2. An apparatus according to claim 1 wherein, said bracket means includes a rigid bracket, a flexible strap-like member secured proximate one end to said bracket and extending therefrom to a distal second end and strap securement means mounted to said bracket and releasably securing said second end, said bracket, said strap-like member and said strap securement means cooperating to extend circumferentially around the entire periphery of said housing.

3. An apparatus for securing a hot water tank, having an outer housing, against lateral movement relative to framing studs or the like of walls defining a corner of a building, said apparatus comprising:

first means extending substantially around the entire periphery of said housing, said first means including a rigid bracket having a first edge and a second edge formed for juxtapositioning against said walls, and said bracket having a third edge formed to substantially mate with and receive a significant portion of said periphery of said housing, and said first means further including a flexible strap-like member mounted to said bracket and extending therefrom, and buckle means mounted for adjustable and releasable securement of a combination of said bracket and said strap-like member substantially around the entire periphery of said housing against transverse movement relative to said housing; and second means for positively securing said bracket of said first means to said framing studs, said second means being mounted to said bracket for movement between a plurality of positions relative to said bracket to permit alignment of said second means with said framing studs, said second means being securable to said bracket at selected ones of said positions against transverse movement relative to said bracket, and said second means including fastening means formed for positive securement to said studs; and said first means being adjustable in its securement around said housing independently of adjustment of said second means, whereby said apparatus provides a substantially slack-free, adjustable coupling between said hot water tank and said framing studs.

4. An apparatus according to claim 3 wherein, said second means include slidable mounting flanges disengagably connected to said first edge and said second edge of said bracket, whereby said flanges may be aligned and fastened to said framing studs.

5. An apparatus according to claim 4 wherein, said bracket includes a plurality of bolt receiving bracket holes spaced apart and extending along said first edge and said second edge, said flanges have at least one flange hole therethrough for alignment with said bracket holes when said flanges are slidably aligned with said framing studs, and connector means dimensioned for and slidably mounted through said bracket holes and said flange holes to secure said flanges to said bracket in a substantially slack-free fixed position.

6.. An apparatus according to claim 5 wherein, one of said bracket and said flanges includes a plurality of holes positioned in outwardly spaced relation from said framing studs to permit securement of said bracket at a plurality of outwardly spaced positions from said framing studs.

7. The apparatus according to claim 6 wherein, said flanges are formed with said plurality of holes positioned in outwardly spaced relation.

8. An apparatus for securing a hot water tank, having an outer housing, against lateral movement relative to framing studs or the like of a building, said apparatus comprising:

first means extending substantially around the entire periphery of said housing, said first means including a rigid bracket having a first edge formed for juxtapositioning against a wall and extending laterally beyond said housing on opposite sides thereof, and said bracket having a second edge formed to substantially mate with and receive a significant portion of said periphery of said housing, and said first means further including a flexible strap-like member mounted to said bracket and extending therefrom, and buckle means mounted for adjustable and releasable securement of a combination of said bracket and said strap-like member substantially around the entire periphery of said housing against transverse movement relative to said housing; and second means for positively securing said bracket of said first means to said framing studs, said second means being mounted to said bracket for movement between a plurality of positions relative to said bracket to permit alignment of said second means with said framing studs, said second means being securable to said bracket at selected ones of said positions against transverse movement relative to said bracket, and said second means including fastening means formed for positive securement to said studs; and said first means being adjustable in its securement around said housing independently of adjustment of said second means, whereby said apparatus provides a substantially slack-free, adjustable coupling between said hot water tank and said framing studs.

9. An apparatus according to claim 8 wherein, said second means include slidable flanges disengagably connected to said first edge of said bracket, whereby said flanges may be aligned and fastened to said framing studs.

10. An apparatus according to claim 9, wherein, said bracket includes a plurality of bolt receiving bracket holes spaced apart and extending along said first edge, said flanges having at least one flange hole therethrough for alignment with said bracket holes when said flanges are slidably aligned with said framing studs.

11. An apparatus for securing a hot water tank, having an outer housing, against lateral movement relative to a wall of a building, said apparatus comprising:

bracket means being secured to said housing against transverse displacement relative to said housing, said bracket means including, a rigid bracket having a first edge and a second edge juxtaposed to walls defining a corner and a third edge formed to substantially mate with and receive a significant portion of said housing, a flexible strap-like member secured proximate one end to said bracket and extending therefrom to a distal second end, and strap securement means mounted to said bracket and releasably securing said second end, said bracket, said strap-like member, and said strap securement means cooperating to extend circumferentially around the entire periphery of said housing to effect substantially slack-free securement of said bracket to said housing against relative transverse displacement; and mounting means for substantially slack-free mounting of said bracket to said walls, said mounting means being disengagably connectable to said bracket at a selected position of a plurality of positions to permit alignment of said mounting means with a plurality of positions along said walls, said mounting means further including fastening means for positively fastening said mounting means to said walls against transverse displacement relative to said walls, whereby said hot water tank is securely affixed to said walls.

12. An apparatus according to claim 11 wherein, said mounting means include slidable flanges disengagably connected to said first edge and said second edge of said bracket, whereby said flanges may be aligned and fastened to said framing studs.

13. An apparatus for securing a hot water tank, having an outer housing, against lateral movement relative to a wall of a building, said apparatus comprising:

bracket means being secured to said housing against transverse displacement relative to said housing, said bracket means including, a rigid bracket having a first edge juxtaposed to said wall and extending laterally beyond the periphery of said housing on both sides of said housing, and a second edge formed to substantially mate with and receive a significant portion of said housing, a flexible strap-like member secured proximate one end to said bracket and extending therefrom to a distal second end, and strap securement means mounted to said bracket and releasably securing said second end, said bracket, said strap-like member, and said strap securement means cooperating to extend circumferentially around the entire periphery of said housing to effect substantially slack-free securement of said bracket to said housing against relative transverse displacement; and mounting means for substantially slack-free mounting of said bracket to said walls, said mounting means being disengagably connectable to said bracket at a selected position of a plurality of positions to permit alignment of said mounting means with a plurality of positions along said walls, said mounting means further including fastening means for positively fastening said mounting means to said walls against transverse displacement relative to said walls, whereby said hot water tank is securely affixed to said walls.

14. An apparatus according to claim 13 wherein, said mounting means includes slidable flanges disengagably connected to said first edge of said bracket, whereby said flanges may be aligned and fastened to a plurality of positions along said wall including positions on both sides of said periphery.

15. In an apparatus for securing a hot water tank against lateral movement relative to a wall having discrete spaced structural members therein, said apparatus including a tank encircling means formed to extend substantially around the entire periphery of said tank, said tank encircling means including a flexible strap-like member and including adjustable and releasable strap securement means for securing said strap-like member in slack-free engagement with said housing, and said apparatus further including mounting means mounted to said tank encircling means and having fastening means formed for securement of said mounting means to a plurality of said structural members, the improvement in said apparatus comprising:

said tank encircling means further including a bracket having a first edge formed to mate with a portion of said periphery and having a second edge formed to extend over a distance greater than the distance between adjacent structural members to enable spanning between adjacent structural members by said bracket, said strap-like member being mounted to said bracket and extending therefrom around said periphery; and said mounting means being movably mounted to said bracket for movement between a plurality of positions relative to said bracket to enable alignment of said mounting means with a plurality of said structural members, and said mounting means being securable to said bracket in alignment with said structural members for positive fastening of said bracket to said structural members by said fastening means.

* * * * *